US005359952A

United States Patent [19]

Klundt et al.

[11] Patent Number: 5,359,952

[45] Date of Patent: Nov. 1, 1994

[54] WATERBORNE CONTAINER CARRIER

[75] Inventors: Victor J. Klundt; Donn L. Williams, both of Rock Island, Ill.

[73] Assignee: Barto International, Inc., Rock Island, Ill.

[21] Appl. No.: 966,259

[22] Filed: Oct. 26, 1992

[51] Int. Cl.[5] ..... B63B 25/00

[52] U.S. Cl. ..... 114/72

[58] Field of Search ..... 114/65 R, 70, 71, 72, 114/73, 76, 26

[56] References Cited

U.S. PATENT DOCUMENTS

| | | | |
|---|---|---|---|
| 1,661,529 | 3/1928 | Ellis . | |
| 3,162,168 | 12/1964 | Ferris et al. | 114/72 |
| 3,273,527 | 9/1966 | Goldman . | |
| 3,550,550 | 12/1970 | Fletcher . | |
| 3,820,664 | 6/1974 | Lewis et al. | 114/72 |
| 3,823,681 | 7/1974 | Cushing et al. . | |
| 3,830,177 | 8/1974 | Nemec et al. . | |
| 3,919,959 | 11/1975 | Nemec et al. . | |
| 4,043,285 | 8/1977 | Nordstrom | 114/72 |
| 4,182,253 | 1/1980 | Bordes | 114/72 |
| 4,846,088 | 7/1989 | Fanse et al. . | |

FOREIGN PATENT DOCUMENTS

| | | | |
|---|---|---|---|
| 136252 | 6/1979 | Germany . | |
| 139785 | 6/1987 | Japan | 114/71 |
| 2088292 | 6/1982 | United Kingdom | 114/71 |
| 491528 | 2/1976 | U.S.S.R. . | |
| 1507640 | 5/1987 | U.S.S.R. . | |

*Primary Examiner*—Stephen P. Avila
*Attorney, Agent, or Firm*—James Creighton Wray

[57] ABSTRACT

A container carrier vessel has a wide, short bow section, a wide and shorter stern section, and an elongated intermediate multi-mode cargo container carrier section extending between the bow section and the stern section. An inverted U-shaped central section divides the long intermediate cargo section and supports a deck for mounting of a track and crane to handle casual cargo loading and unloading. The U-shaped section has a tunnel space for carrying communications between the bow and stern sections, and has provision for mounting a personnel mover. The stern section has a retractable pilot house mounted atop a telescoping mast for maintaining high elevation viewing of surrounding conditions and retracting to avoid overhead obstructions such as bridges. The vessel has a welded steel plate fore and welded side bulkheads and stern bulkheads, and sloped prow. The propulsion system mounted in the after section drives the propellers, and bow and stern thrusters are provided with pumps and controls in the bow and stern sections.

7 Claims, 2 Drawing Sheets

WATERBORNE CONTAINER CARRIER

BACKGROUND OF THE INVENTION

Classicly, Mississippi River multi-mode containers move in barges connected in strings which are moved up and down river by towboats. Negotiating locks requires separating the strings, making a "double locking" raising and lowering the water twice, then refastening the barges back together, a task that requires 1.5 to 2 hours, which adds to transit costs and to the inventory-like costs of goods in transit. Negotiating of locks and "waiting turn" delays account, on the upper Mississippi River, for a substantial part of the total transit time.

SUMMARY OF THE INVENTION

The present invention solves the existing problems in the art by providing a single container carrier having a capacity of 600 multi-mode cargo transportation containers. The vessel, which substantially fills existing river locks, takes advantage of the full capacity of the lock to quickly move a large number of containers through the lock. As such, the vessel avoids much of the barge handling motions required to move a similar cargo through a lock. By avoiding the motions, the vessel also saves time and the number of personnel required for handling the vessel through the locks.

This in conjunction with the vastly increased volumetric efficiency (it takes 17 conventional barges to equal the container content of one container carrier) produces a greatly improved methodology.

While a conventional string of barges that carries this much cargo is passing through one lock, the present vessel may be four locking times further along the river. The overall time saving provided by the present invention enables the shipment of perishable materials and reduces overhead costs of in-transit inventory and cargo shipment.

The unitary and compact nature of the craft also reduces numbers of impacts and collisions with fixed obstacles and locks, reducing the bumping, which requires maintenance both to the locks and vessels.

The new container haulers' technology will overcome the two principal difficulties which have plagued those trying to move containers by barge. They are extended travel time, and relatively small savings in transportation dollars.

The present container carrier will reduce travel time to substantially less than half that of the towboat-barge combination, thus easing the burdens of inventory interest and scheduling, yet retaining the inherent advantage of waterborne freights' low rates.

By way of explanation, a typical Mississippi River barge is 195' long and 35' wide. Fully loaded to a 9' draft it carries 1500 tons of cargo. Equally important in this equation are the dimensions and capacities of containers. They are 8' wide, 8.5' high and 40' long, i.e. forty foot equivalent units (F.E.U.). Some are 20' long, thus are T.E.U.'s. Road use limits are 40,000 lbs. (20 tons).

The cargo compartment of a typical Mississippi River barge is slightly under 30' wide and, dead flat, about 160' long, those dimensions limiting to three 8' wide containers abreast, and four 40' containers long, which equals 12 containers per layer.

Due to center of gravity restrictions, three containers high is the stability limit for a barge 35' wide.

Since wider means more stable in this case, making a vessel twice as wide would, for practical purposes, make it twice as stable. Logically then, making it three times wider should naturally produce even greater stability.

Restricted vertically by the lowest overhead clearance of bridges and like obstructions, and horizontally by the limitations of the smallest common denominator, namely, the locks, maximum dimensions soon evolved. Width of the locks on the Upper Mississippi is 110' and the shortest length is 600'. Allowing for a little clearance and ice build-up in cold weather, vessel dimensions of 595' by 107' are practical.

This type of vessel can be configured to be self-unloading, or with ramps, for roll-off roll-on cargo, or set up to be a refrigerated container mover. As is, it could be used to haul extremely heavy shipments, that is, pieces of up to several hundred tons.

Alternatively, different sized vessels, so long as proportional dimensions are maintained, either larger or smaller, self propelled or towed, can be built for use on waterways in the U.S. and abroad.

Chart 1
STATISTICS

| | |
|---|---|
| LENGTH | 595 FEET |
| WIDTH | 107 FEET |
| EMPTY WEIGHT | 2700 TONS |
| HORSEPOWER | 3600 |
| CAPACITY | 600 F.E.U. (12,000 TONS) |
| EMPTY DRAFT | 26" |
| LOADED DRAFT | 9' (PROJECT DEPTH) |
| WHEELHOUSE | RETRACTABLE |
| HEIGHT ABOVE WATER | 42.5 FEET LOADED (WHEELHOUSE RETRACTED) |
| CONSTRUCTION COST | $5,500,000.00 |

Chart 2
ANNUAL OPERATING
COSTS FOR CONTAINER HAULER

| | |
|---|---|
| Annual Payments @ 10% | $1,375,000.00 |
| Insurance | $250,000.00 |
| Fuel use @ 3600 H.P. | $900,000.00 |
| Crew (7) | $600,000.00 |
| Engine Maintenance | $200,000.00 |
| | $3,145,000.00 |

With a 300 day season and round trip average of twelve days, twenty-five trips @600 containers = 15,000 annual capacity. At average cost per container of $209.66, one way haul, with a payload both ways the cost would decrease by a hundred dollars or so per container.

Bearing in mind the dramatic fluctuations in draft from empty to loaded, much thought was given to methods of compensation for these differences. Selected as best for several reasons are the hydraulic, steerable units manufactured by Thrustmaster of Texas. They can accomplish easily the requirement to remain efficient at varying vessel drafts and produce the outstanding handling characteristics dictated by the extremely high sectional presentation to the effects of wind.

With a single all-direction "bow thruster" at the bow of the vessel and multiple similar units at the stern, for both propulsion and steering, any handling problems should be met.

Closed circuit T.V. and permanent communications with the lead corners of the vessel will make maneuvering safe and quick at locks, bridges and dock sites.

A container carrier vessel has a wide, short bow section, a wide and shorter stern section, and an elongated intermediate multi-mode cargo container carrier section extending between the bow section and the stern section. An inverted U-shaped central section divides the long intermediate cargo section and supports a deck for mounting of a track and crane to handle casual cargo loading and unloading. The U-shaped section has a tunnel space for carrying communications between the bow and stern sections, and has tracks for mounting a personal mover. The stern section has a retractable pilot house mounted atop a telescoping mast for maintaining high elevation viewing of surrounding conditions and retracting to avoid overhead obstructions such as bridges. This is a proved option to a fixed pilot house mounted on the bow. The vessel has a welded steel plate fore and welded side bulkheads and stern bulkheads, and sloped prow. The propulsion system mounted in the after section drives two or more propellers, and bow and stern thrusters are provided with pumps and controls in the bow and stern sections.

The water borne container apparatus of the present invention has a hull having a flat bottom U-shaped cross section and having an elongated mid-section, and having a short bow section and a shorter stern section and a relatively long intermediate container carrier section. An inverted U-shaped channel section extends lengthwise of a ship between the stern section and bow section and centrally through the container carrying section.

The carrier comprises a watertight steel shell comprising a flat, wide, long floor. First and second opposite side bulkheads extend upward from the floor. A stern bulkhead is connected to rear ends of the side bulkheads and a bow is connected to front ends of the side bulkheads. The bow has opposite triangular lateral sections which project forwardly from forward ends of the side bulkheads. A flat prow plate extends upward from a forward end of the floor along sloping edges of the bow side plates.

A vertically extensible mast is mounted centrally in the stern section. A pilot house is positioned atop the mast for elevating and retracting the pilot house according to the absence or presence of vertical obstructions.

A deck plate is situation atop the U-shaped central section, and tracks are positioned thereon for mounting a cargo-handling crane thereon.

A car is mounted within the U-shaped section for shuttling crew and consumables.

Crew quarters can be placed either fore or aft, or both.

The flat floor receives 600 standard multi-mode containers having dimensions of about 40×8.5×8 feet stacked five high in rows of five on each side of the U-shaped section.

The ship is rectangular in planform and is of a size which substantially fills a standard river lock.

These and further and other objects and features of the invention are apparent in the disclosure, which includes the above and ongoing written specification, with the claims and the drawings.

DETAILED DESCRIPTION OF THE DRAWINGS

Figure 1:
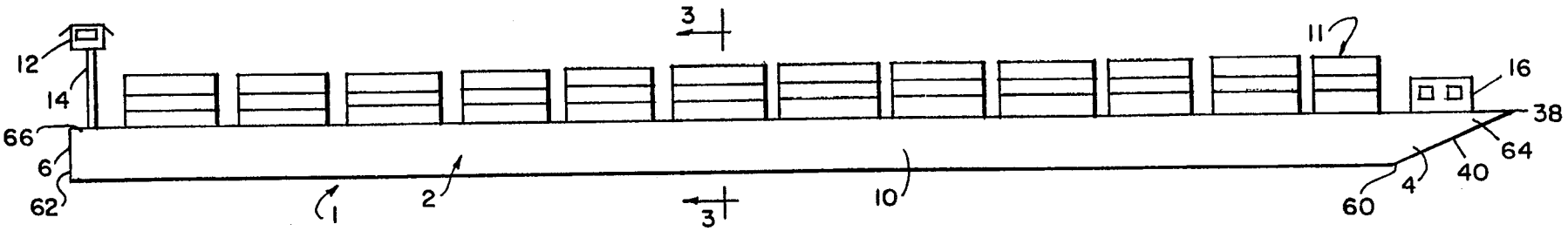
FIG. 1 is a side elevation of the container carrier of the present invention.
Figure 2:
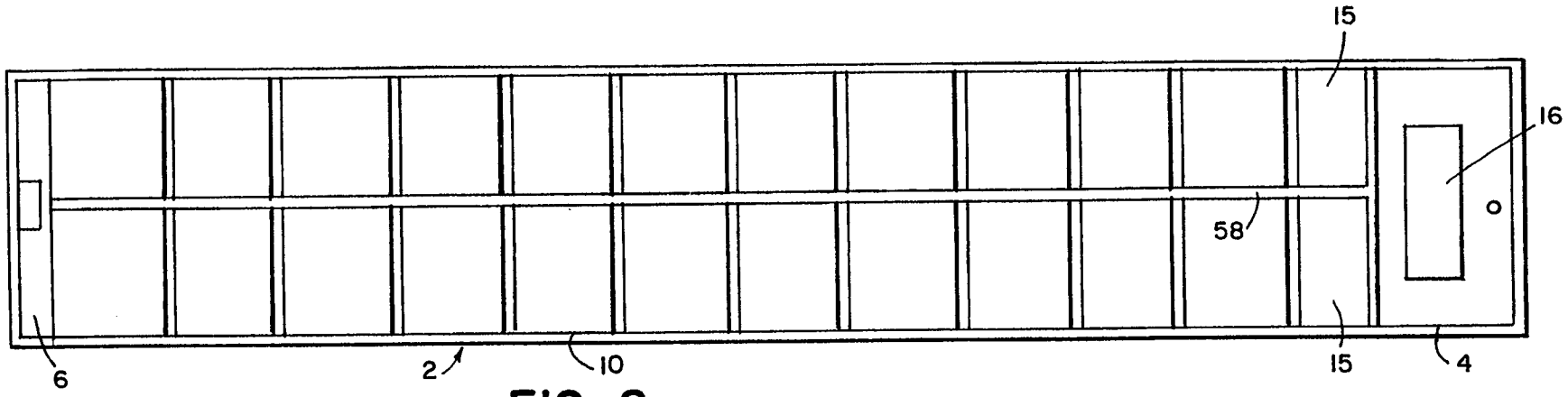
FIG. 2 is a top plan view of the invention.
Figure 3:
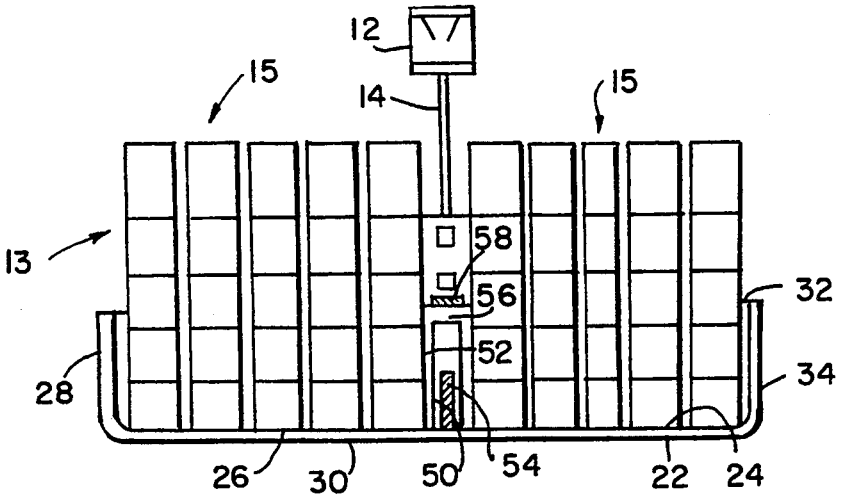
FIG. 3 is a section taken along lines 3—3 of FIG. 1.

Referring to the drawings, the container carrier is generally referred to by the numeral 1. The carrier has a hole 2 a bow section 4, a stern section 6, and an amidships cargo container section 10.

The cargo section 10 holds 600 containers 11 stacked in levels 13 of five high, and parallel rows 15 of five containers wide.

A retractable pilot house 12 is mounted on a telescoping mast 14, which is hydraulically operated to raise and lower the pilot house between a maximum height for improved vision, and a retracted level for bridge clearance. A crews' quarters 16 is provided on the front section.

The hull 2 is made of double hull construction with outer and inner plates 22 and 24 attached to angle irons, which are connected to the flat ship floors 26 and vertical risers 28, and stringers which are not shown. The upper rails 32 are about 20 feet above the flat bottom keel 30. The hull is formed thus with a flat bottom and vertical side bulkheads 34, and a flat stern bulkhead 36. The prow 38 of the ship is formed of a sloped double wall section 40 and triangular extensions 42 of the side bulkheads.

A central U-shaped structure 50 is provided with vertical beams 52 surrounding an opening 54, and horizontal beams 56 supporting a central deck 58. Fore and aft communications are provided through channel 54, and car vehicles for crew travel may move through the channel. The deck 58 may be provided with an auxiliary crane for movement on rails along the deck and off or onloading containers at intermediate ports without container crane facilities. Such a crane moves on telescoping masts and is stored longitudinally between the rows 15 of containers from where it may be elevated by extending the mast and swung through a 90° angle to facilitate lateral container movement.

Alternatively, the crane may be lifting and longitudinally moving containers only from the innermost rows.

Steering is augmented by a single universally movable bow thruster with a pump unit in the bow section, and by two or more universally directable stern thrusters. The bow thrusters are schematically indicated by the numeral 60, and the stern thrusters are schematically indicated by the numeral 62.

Closed circuit television and ranging devices, generally indicated by the numerals 64 and 66, are provided in the stern for precise maneuvering in locks, bridges and docks.

Figure 4:
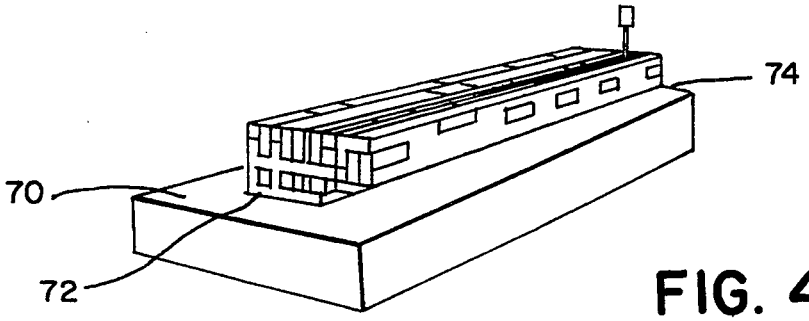
FIG. 4 is a perspective view of one side of the invention.
Figure 5:
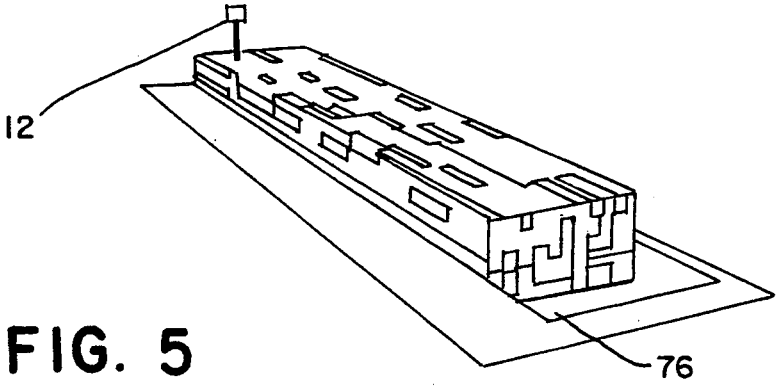
FIG. 5 is a perspective view of the other side of the invention.

As shown in the perspective views of FIGS. 4 and 5, a vessel 70 may be provided with a low, flat foredeck 72 and afterdeck 74 for roll-on and roll-off loading and unloading. The bow 76 has an upward sloping flat hull and downward curved forward sections of the side bulkheads. The pilot house 12 is shown in extended position.

While the invention has been described with reference to specific embodiments, modifications and variations of the invention may be constructed without departing from the scope of the invention, which is defined in the following claims.

We claim:

1. Inland waterway self-propelled water borne container carrier vessel comprising a hull having a flat bottom U-shaped cross section and having an elongated mid-section, and having a short bow section and a shorter stern section and a relatively long intermediate container carrier section, a U-shaped channel section extending lengthwise of the vessel between the stern section and bow section and through the container carrying section, wherein the vessel is rectangular in planform and is of a size which substantially fills a standard 600′×110′ river lock.

2. The apparatus of claim 1, wherein the carrier vessel comprises a watertight steel shell comprising a flat, wide, long bottom plate with first and second opposite side bulkheads extending upward from the bottom plate, and a stern bulkhead connected to rear ends of the side bulkheads and a bow connected to front ends of the side bulkheads, the bow comprising opposite triangular lateral sections projecting forwardly from forward ends of the side bulkheads, and a flat prow plate extending upward from a forward end of the bottom plate along sloping edges of the bow side plates.

3. The apparatus of claim 1, further comprising a deck plate atop legs of the U-shaped central section, and tracks positioned thereon for mounting a cargo-handling crane thereon.

4. The apparatus of claim 1, further comprising modular crew quarters mounted on top of the vessel.

5. The apparatus of claim 1, wherein the hull receives 600 standard multi-mode containers having dimensions of about 40×8.5×8 feet stacked five high in rows of ten wide.

6. The apparatus of claim 1, wherein the ship is rectangular in planform and is of a size which substantially fills a standard river lock.

7. Self-propelled inland waterway container carrier vessel comprising a flat bottom U-shaped cross section hull and having an elongated mid-section, a short bow section and a shorter stern section and a relatively long intermediate container carrier section, a U-shaped channel section extending lengthwise of the vessel between the stern section and bow section and through the container carrying section, wherein the carrier comprises a watertight double hull steel shell comprising a flat, wide, long bottom plate with first and second opposite side bulkheads extending upward from the bottom plate, and a stern bulkhead connected to rear ends of the side bulkheads and a bow connected to front ends of the side bulkheads, the bow comprising opposite triangular lateral sections projecting forwardly from forward ends of the side bulkheads, and a prow plate extending upward from a forward end of the bottom plate along sloping edges of the bow side plates, wherein the vessel is rectangular in planform and is of a size which substantially fills a standard 600′×110′ river lock.

* * * * *